US012807384B2

(12) United States Patent
Chen

(10) Patent No.: US 12,807,384 B2
(45) Date of Patent: Nov. 24, 2026

(54) LIQUID CONTAINER ASSEMBLY

(71) Applicant: MORDECO CO., LTD., Taipei City (TW)

(72) Inventor: Shih-Yao Chen, New Taipei City (TW)

( * ) Notice: Subject to any disclaimer, the term of this patent is extended or adjusted under 35 U.S.C. 154(b) by 47 days.

(21) Appl. No.: 19/174,935

(22) Filed: Apr. 10, 2025

(65) Prior Publication Data

US 2026/0317028 A1 Oct. 15, 2026

(51) Int. Cl.
*B65D 55/16* (2006.01)
*A45F 3/16* (2006.01)
*B65D 43/02* (2006.01)

(52) U.S. Cl.
CPC ..... *B65D 55/16* (2013.01); *A45F 3/16* (2013.01); *B65D 43/0229* (2013.01); *B65D 43/0231* (2013.01); *B65D 2251/20* (2013.01)

(58) Field of Classification Search
CPC ..... B65D 55/16; B65D 43/0229; A45F 3/16
USPC ..... 215/306
See application file for complete search history.

(56) References Cited

U.S. PATENT DOCUMENTS 2,957,596 A * 10/1960 Rehborg ..... A47J 41/0083 215/386
3,841,528 A * 10/1974 Eisenberg ..... A47G 19/12 220/817
5,244,106 A * 9/1993 Takacs ..... B65D 23/12 220/744
5,897,010 A * 4/1999 Soyka, Jr. ..... B65D 21/0237 215/390
7,419,067 B2 * 9/2008 Bouie ..... B65D 43/169 220/834
8,371,244 B2 * 2/2013 Krasner ..... A01K 7/00 119/72.5
8,443,993 B1 * 5/2013 Desselle ..... B65D 55/16 215/354
8,613,369 B2 * 12/2013 Kitto ..... B65D 55/16 215/390
D764,916 S * 8/2016 Mount, III ..... D9/443
D814,852 S * 4/2018 Melanson ..... D7/378
D818,775 S * 5/2018 Woodruff ..... D9/503
11,021,314 B2 * 6/2021 Tolman ..... A47J 41/0016
D936,480 S * 11/2021 Giuili ..... D9/524
12,172,804 B2 * 12/2024 Hawes ..... B65D 21/0233
2006/0249471 A1 * 11/2006 Leposavic ..... B65D 55/16 220/500
2008/0142466 A1 * 6/2008 Balitski ..... B65D 23/12 215/6
2009/0134112 A1 * 5/2009 Reeves ..... B65D 55/16 215/11.1

(Continued)

FOREIGN PATENT DOCUMENTS

CN 103619723 B 1/2016
KR 20-0386913 6/2005
TW I348439 B1 9/2011

*Primary Examiner* — Ernesto A Grano

(57) ABSTRACT

A liquid container assembly includes a cup-shaped container and a top cover. The cup-shaped container has a liquid accommodating space and a container opening communicating with the liquid accommodating space. The top cover is selectively detachably engaged with the container opening to cover the container opening, or detachably engaged with the cup-shaped container through an engagement structure so as to be firmly attached to a side of the cup-shaped container and expose the container opening.

3 Claims, 10 Drawing Sheets

(56) References Cited

U.S. PATENT DOCUMENTS

| | | | | |
|---|---|---|---|---|
| 2009/0152231 | A1* | 6/2009 | Hanson | B65D 55/16 220/379 |
| 2012/0199548 | A1* | 8/2012 | Kitto | B65D 55/16 215/316 |
| 2017/0305614 | A1* | 10/2017 | Koehl | A47G 23/0216 |
| 2018/0105346 | A1* | 4/2018 | Tolman | A47J 41/0016 |
| 2019/0047773 | A1* | 2/2019 | Bullock | B65D 41/0414 |
| 2020/0037799 | A1* | 2/2020 | Johnson | B65D 81/3876 |

* cited by examiner

LIQUID CONTAINER ASSEMBLY

BACKGROUND OF THE INVENTION

1. Field of the Invention

The present invention relates to a liquid container, and more particularly to a liquid container assembly with a top cover.

2. Description of the Prior Art

Generally speaking, a cup is a container with an opening, to which a cover can be used to cover the opening. By removing the cover from the opening, a user can drink the water or beverage in the cup. At this time, if the cover is separate from the cup, the user needs to hold or place the cover; if the cover is still connected to the cup (e.g., through a rope or a pivot structure), the cover may shake or rotate relative to the cup when drinking the water or beverage in the cup. The above situations cause some inconvenience to users.

SUMMARY OF THE INVENTION

In view of the problems in the prior art, an objective of the invention is to provide a liquid container assembly.

A liquid container assembly of an embodiment according to the invention includes a cup-shaped container and a top cover. The cup-shaped container has a liquid accommodating space and a container opening communicating with the liquid accommodating space. The top cover is selectively detachably engaged with the container opening to cover the container opening, or detachably engaged with the cup-shaped container through an engagement structure so as to be firmly attached to a side of the cup-shaped container and expose the container opening. Thereby, when the top cover is on the side of the cup-shaped container to expose the container opening, a user can take out the contents (such as water, beverages, etc.) of the liquid accommodating space through the container opening without placing the top cover additionally (such as holding or placing it on the table), and there is no need to worry about the top cover shaking or rotating relative to the cup-shaped container to affect the taking out.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
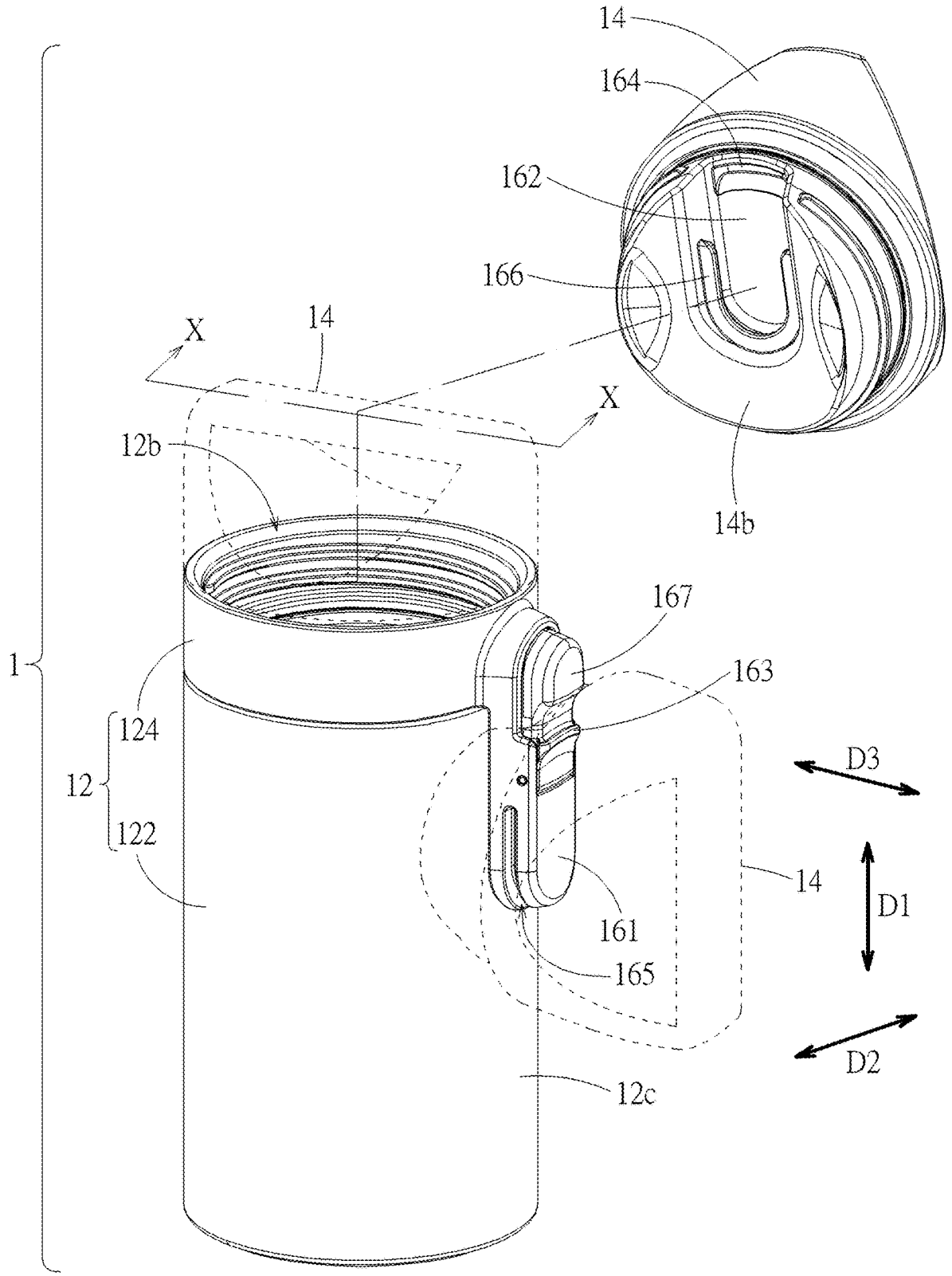
FIG. 1 is a partially-exploded view of a liquid container assembly according to an embodiment.
Figure 2:
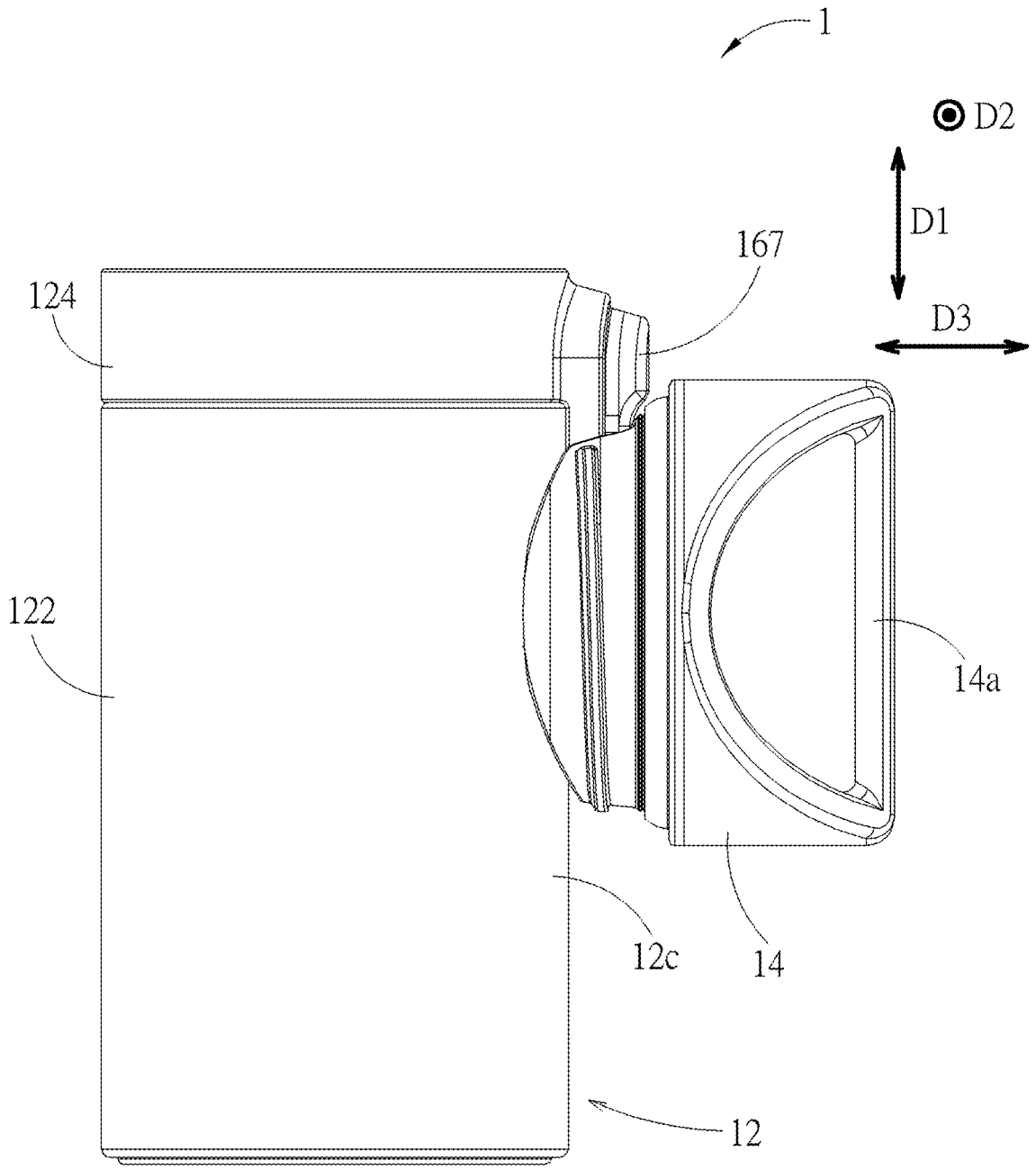
FIG. 2 is a side view of the liquid container assembly in FIG. 1 with the top cover attached to a side of the cup-shaped container.

Please refer to FIG. 1 and FIG. 2. A liquid container assembly 1 according to an embodiment includes a cup-shaped container 12 and a top cover 14. The cup-shaped container 12 has a liquid accommodating space 12*a* (referring to FIG. 3) and a container opening 12*b* communicating with the liquid accommodating space 12*a*. The top cover 14 can be selectively detachably engaged with the container opening 12*b* (e.g., by threaded connection) to cover the container opening 12*b* (indicated by the top cover 14 in dashed lines in FIG. 1 covering the container opening 12*b*), or detachably engaged with the cup-shaped container 12 through an engagement structure so as to be firmly attached to a side of the cup-shaped container 12 and expose the container opening 12*b* (indicated by the top cover 14 in FIG. 1 in dashed lines attached to the side of the cup-shaped container 12; its side view is shown by FIG. 2). Thereby, a user can selectively attach the top cover 14 firmly to the side of the cup-shaped container 12, and then take out the contents (such as water, beverages, etc.) of the liquid accommodating space 12*a* through the container opening 12*b*; there is no need to worry about the top cover 14 shaking or rotating relative to the cup-shaped container 12 to affect the taking out.

Figure 3:
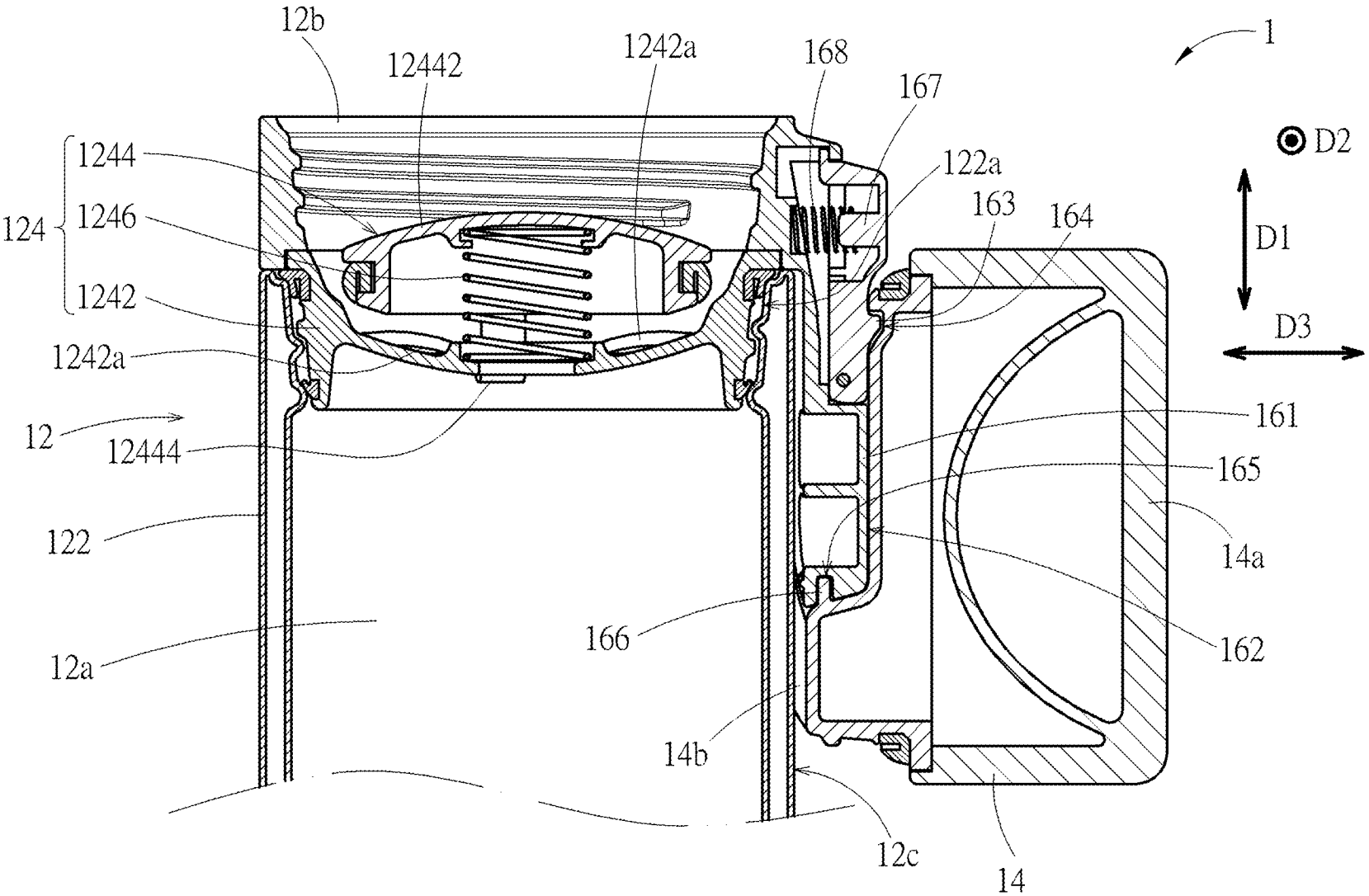
FIG. 3 is a sectional view of the liquid container assembly in FIG. 2 along the line X-X in FIG. 1.

Please also refer to FIG. 3. The engagement structure includes a protrusion block 161, a recess 162 structurally fitting the protrusion block 161, a hook 163, a lock slot 164 structurally fitting the hook 163, a narrow slot 165, and a plate rib 166 structurally fitting the narrow slot 165. The protrusion block 161 and the hook 163 are disposed on the cup-shaped container 12. The recess 162 and the lock slot 164 are disposed on the top cover 14. The narrow slot 165 is disposed on the protrusion block 161. The plate rib 166 is disposed in the recess 162. The top cover 14 moves upward from bottom to top (i.e., in the direction D1), and by the protrusion block 161 being inserted into the recess 162, the plate rib 166 being inserted into the narrow slot 165, and the hook 163 being snapped into the lock slot 164, the top cover 14 is firmly attached to the side of the cup-shaped container 12 and exposes the container opening 12*b*. Thereby, the engagement structure can structurally constrain the top cover 14 in the three directions D1, D2, and D3 (indicated by double-headed arrows in the figures). Afterward, the top cover 14 can be separated from the cup-shaped container 12 by disengaging the hook 163 from the lock slot 164 and moving the top cover 14 in the reverse direction.

Therein, the narrow slot 165 is formed on the protrusion block 161 and extends along a U-shaped path on three sides of the protrusion block 161. The plate rib 166 also extends along a U-shaped path. It helps the top cover 14 to be firmly attached to the cup-shaped container 12. In practice, the narrow slot 165 can be disposed in the recess 162 instead; the plate rib 166 is disposed on the protrusion block 161 instead. Moreover, the protrusion block 161 can be disposed on the top cover 14 instead; the recess 162 can be disposed on the cup-shaped container 12 instead. In addition, the engagement of the narrow slot 165 and the plate rib 166 can provide structural constraint for the top cover 14 in the direction D3. In practice, the narrow slot 165 and the plate rib 166 can be removed and replaced with other structures to achieve the above structural constraint. For example, the recess 162 is a dovetail groove, and the protrusion block 161 is a matching slider.

Furthermore, the engagement structure also includes a press button 167 pivotally connected to the cup-shaped container 12 (indicated by the cross mark in FIG. 3), and an elastic reset part 168 (e.g., a coil spring) tightly pressing against and between the press button 167 and the cup-shaped container 12. The hook 163 is disposed on the press button 167. The elastic reset part 168 pushes the press button 167 outward to keep the hook 163 hooking the lock slot 164. Pressing the press button 167 can disengage the hook 163 from the lock slot 164. This configuration enables the hook 163 to be elastically engaged with the locking slot 164. When the top cover 14 is on the side of the cup-shaped container 12, the press button 167 is exposed so that the user can press the press button 167 to release the top cover 14 from the cup-shaped container 12 and then the top cover 14 can be moved away from the cup-shaped container 12.

As shown by FIG. 1 and FIG. 2, the top cover 14 has an inner surface 14*b*, on which the engagement structure is disposed (wherein the recess 162 is formed on the inner surface 14*b*, the lock slot 164 is formed on the bottom of the recess 162, and the plate rib 166 protrudes from a side wall of the recess 162). When the top cover 14 is on the container opening 12*b*, the inner surface 14*b* faces an inner side of the cup-shaped container 12. When the top cover 14 is on the side of the cup-shaped container 12, the inner surface 14*b* faces an outer surface 12*c* of the cup-shaped container 12 and conforms to the contour of the outer surface 12*c*.

In addition, when the top cover 14 is on the container opening 12*b*, the user can grasp a handle 14*a* of the top cover 14 to lift the liquid container assembly 1. When the top cover 14 is on the side of the cup-shaped container 12, the user can grasp the handle 14*a* to control the posture of the cup-shaped container 12.

Figure 4:
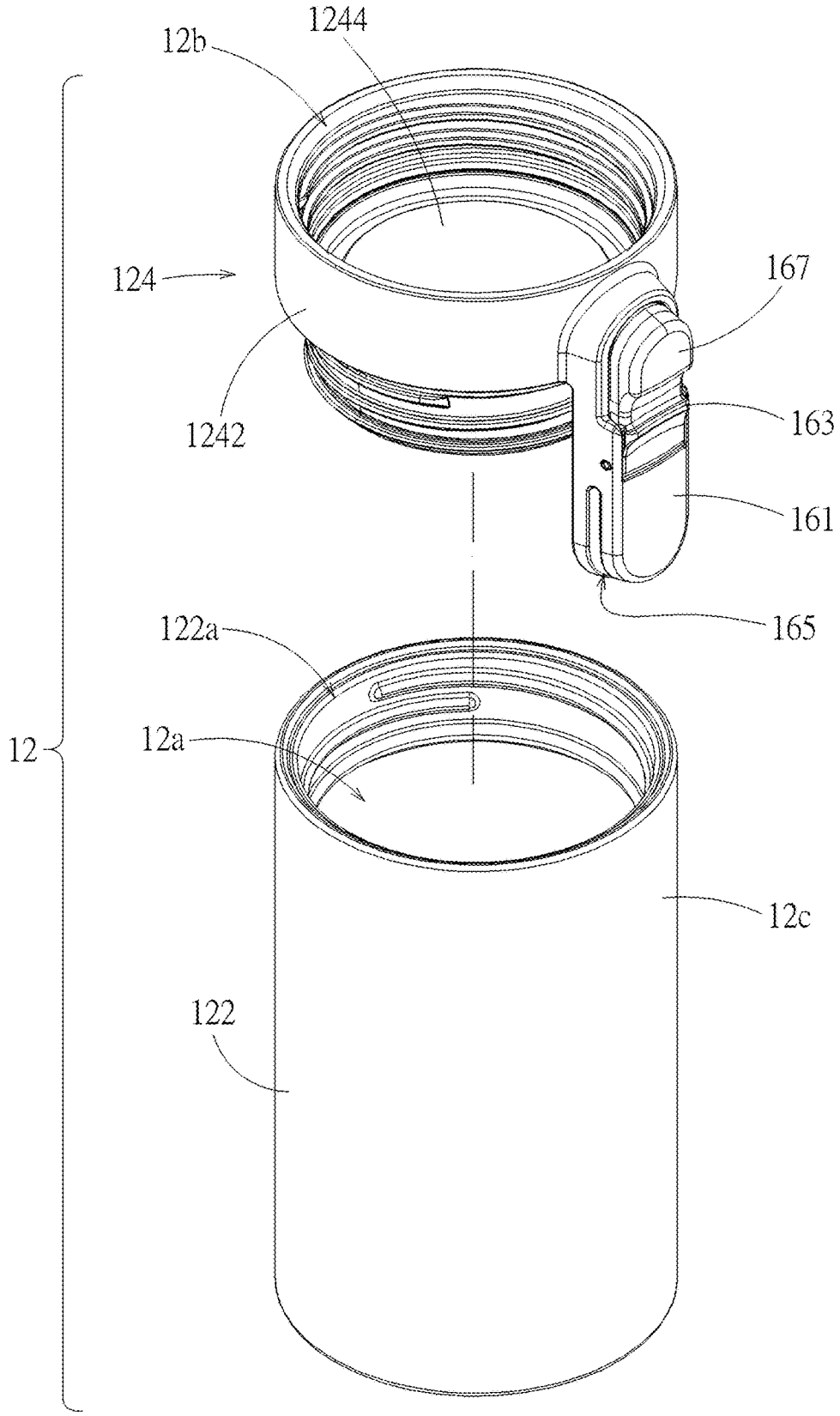
FIG. 4 is a partially-exploded view of the cup-shaped container in FIG. 1.
Figure 5:
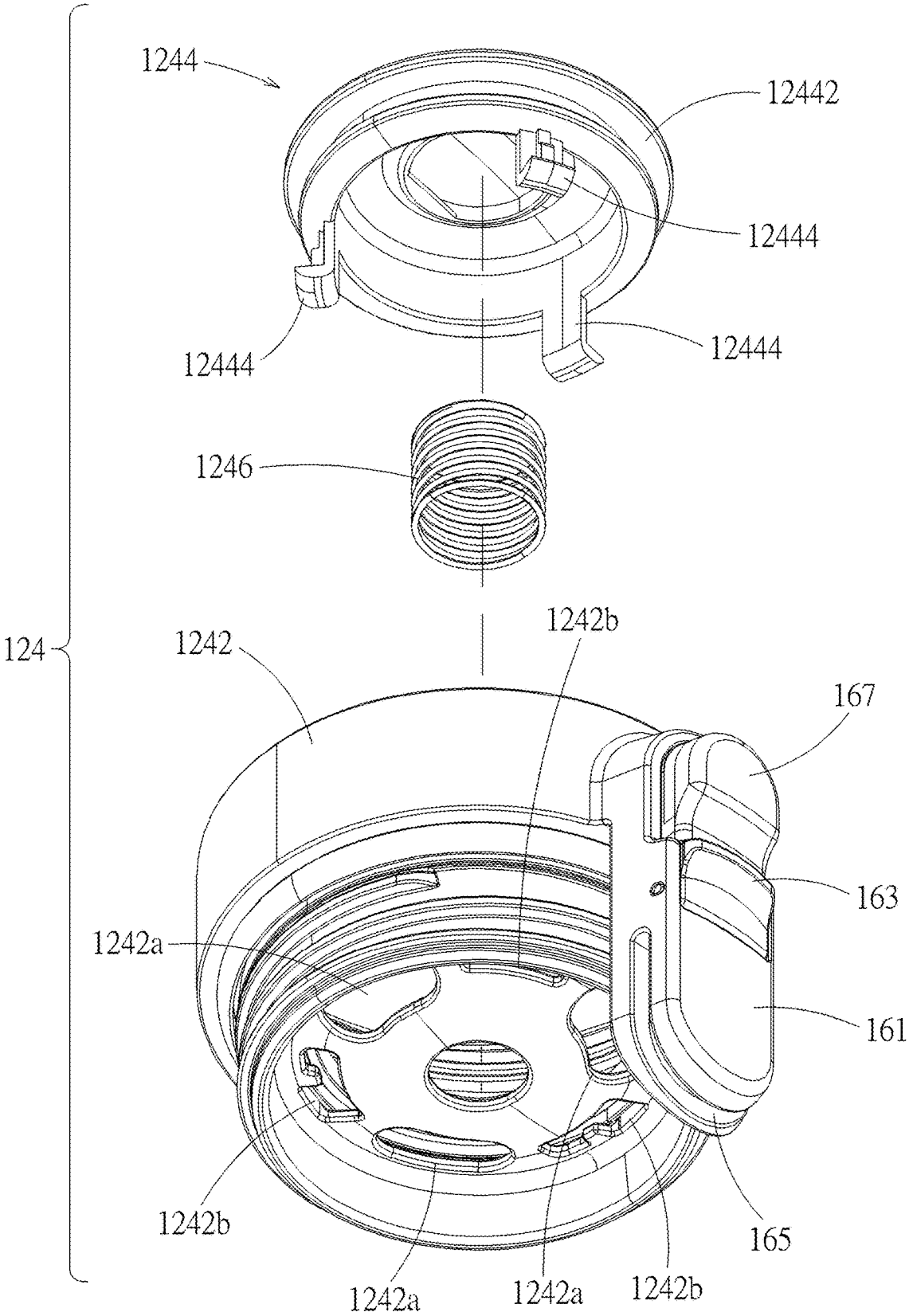
FIG. 5 is an exploded view of the cup cover of the cup-shaped container in FIG. 4.
Figure 6:
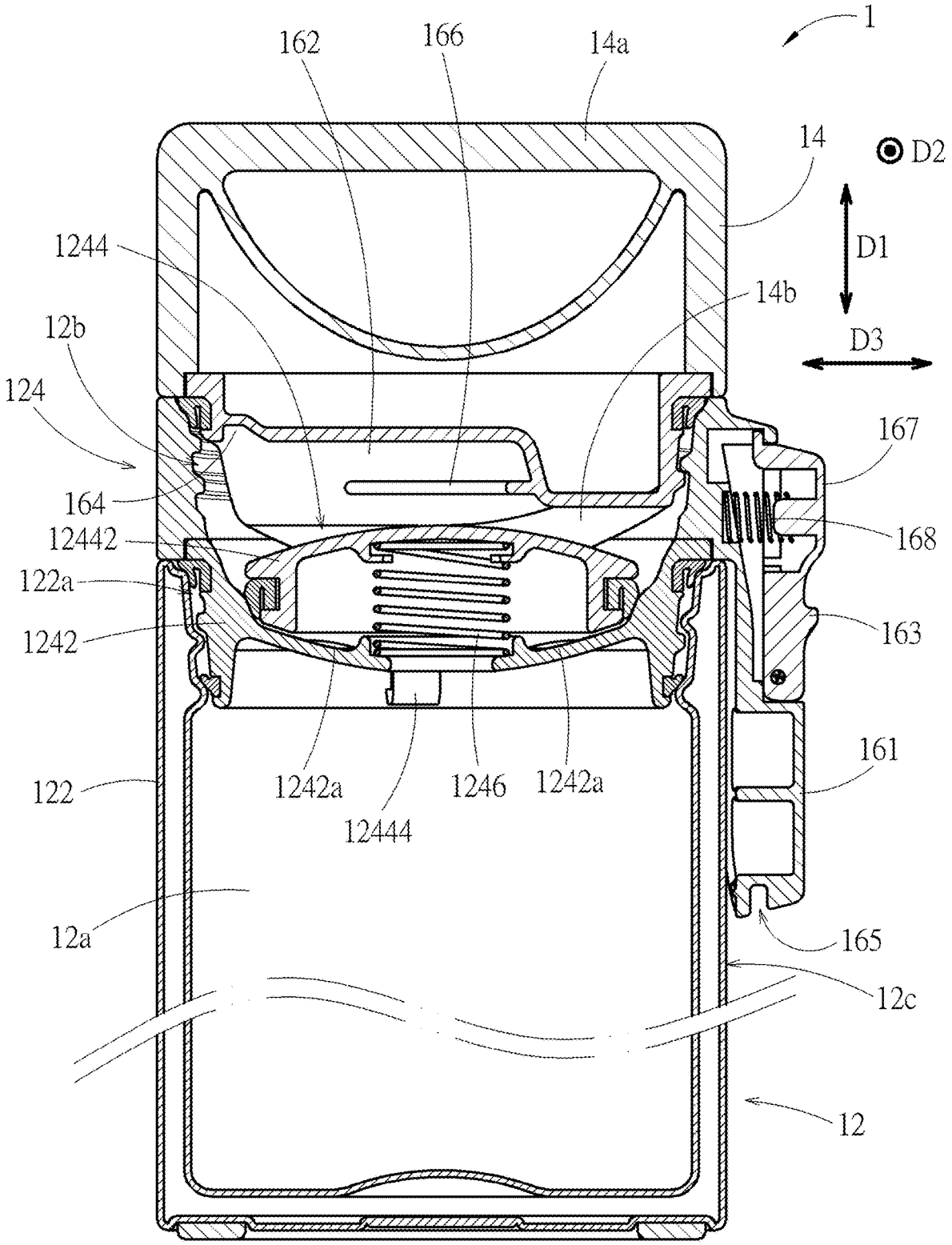
FIG. 6 is a sectional view of the liquid container assembly in FIG. 1 along the line X-X, with the top cover engaged with the container opening of the cup-shaped container.
Figure 7:
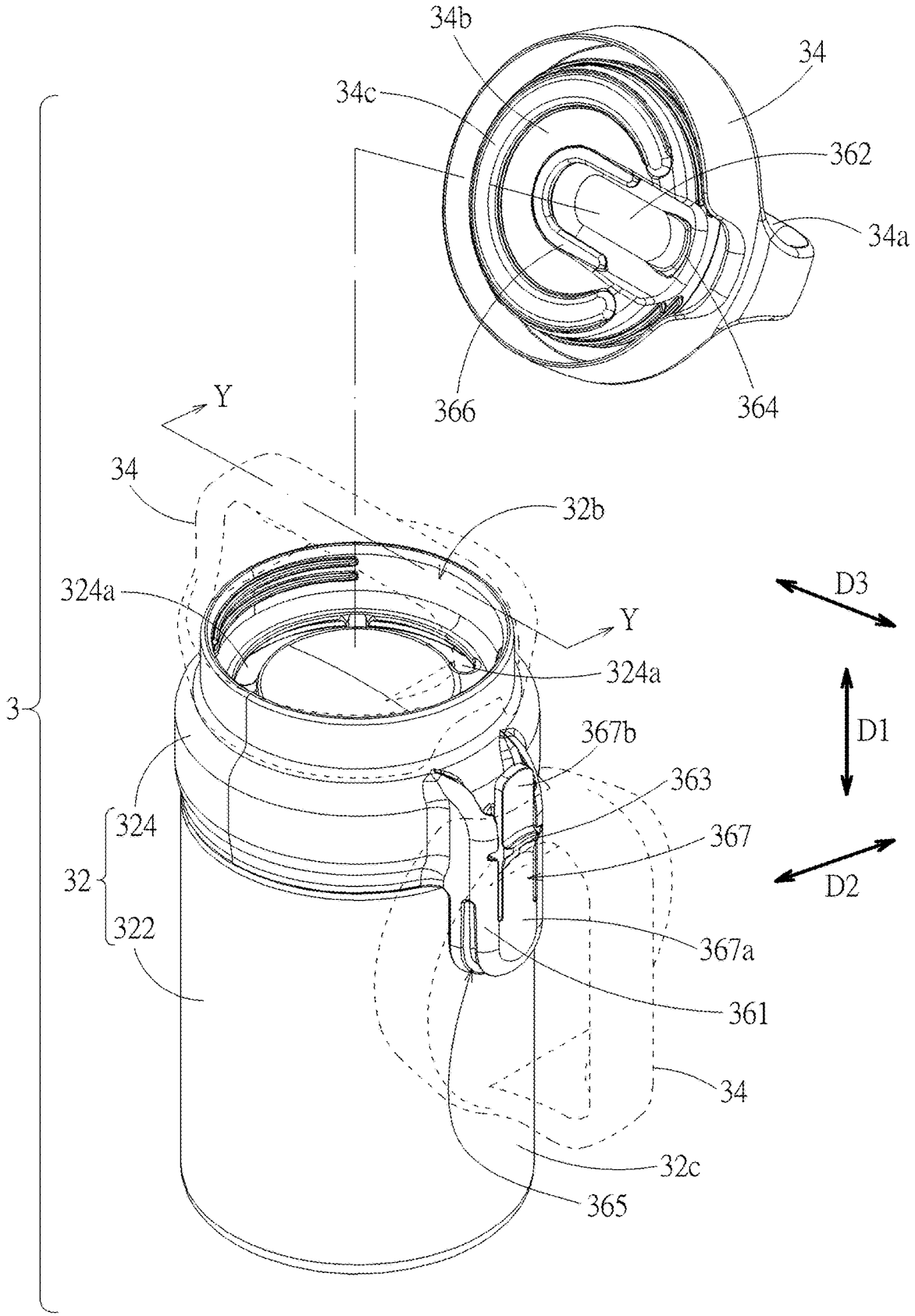
FIG. 7 is a partially-exploded view of a liquid container assembly according to another embodiment.
Figure 8:
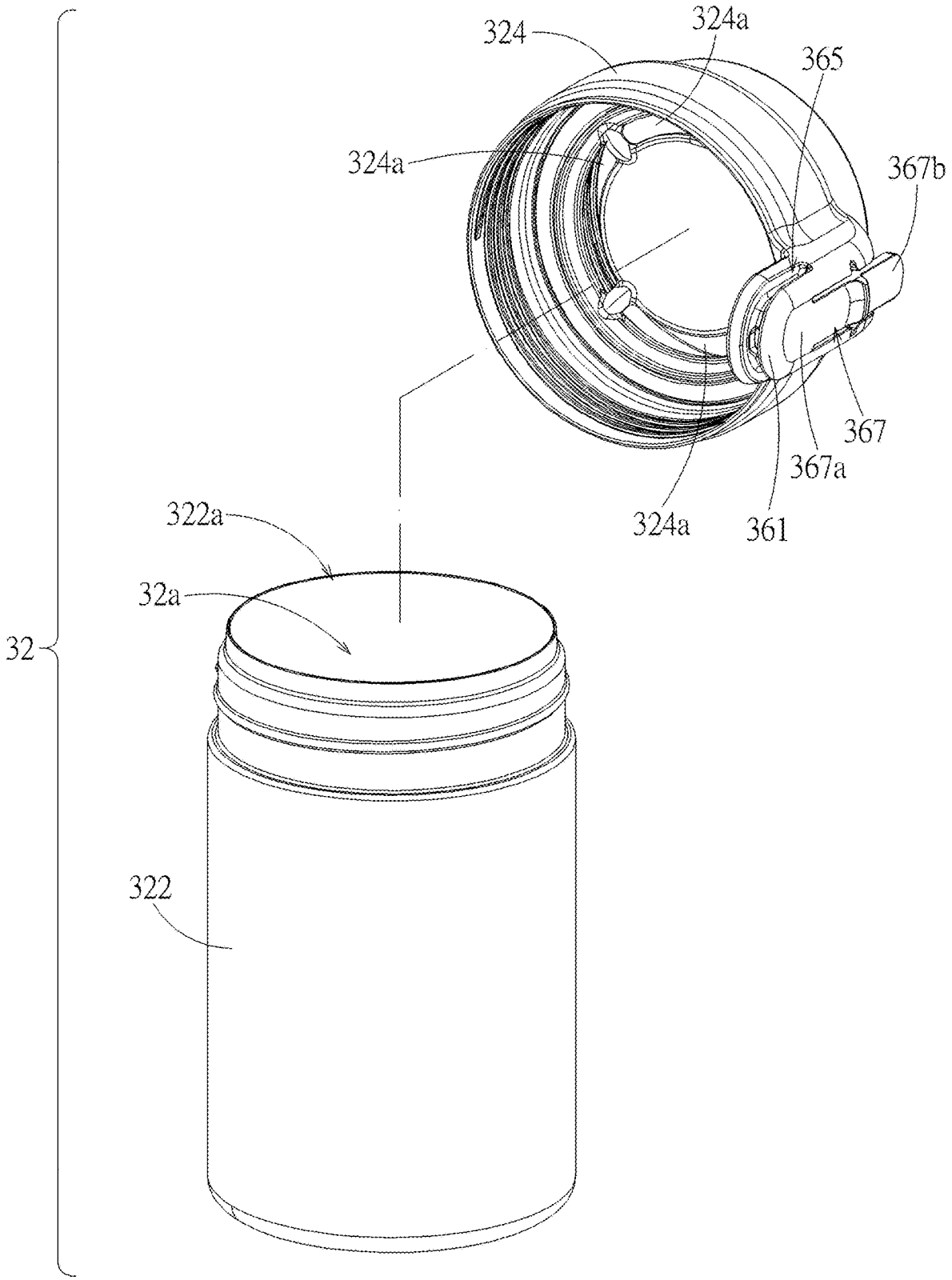
FIG. 8 is a partially-exploded view of the cup-shaped container of the liquid container assembly in FIG. 7.

Please refer to FIG. 4 and FIG. 5. The cup-shaped container 12 includes a cup body 122, and a cup cover 124 detachably engaged with the cup body 122 to form the liquid accommodating space 12*a*. The engagement structure is disposed on the cup cover 124. The cup cover 124 includes a cover body 1242 with a plurality of passages 1242*a*, a stopper 1244 movably disposed on the cover body 1242 corresponding to the passages 1242*a*, and an elastic part 1246 (e.g., a coil spring) tightly pressing against and between the stopper 1244 and the cover body 1242. The cup cover 124 is detachably engaged with the opening 122*a* of the cup body 122 through the cover body 1242 (e. g., by threaded connection) to form the liquid accommodating space 12*a*. The passages 1242*a* connect the liquid accommodating space 12*a* and the opening of the cover body 1242; the opening of the cover body 1242 serves as the container opening 12*b*. When the top cover 14 is on the container opening 12*b*, the top cover 14 pushes the stopper 1244 to close the passages 1242*a*, i.e., to seal the liquid accommodating space 12*a* (FIG. 6). When the top cover 14 is removed away from the container opening 12*b*, the elastic part 1246 pushes the stopper 1244 to open the passages 1242*a*, so that the liquid accommodating space 12*a* is open to the outside through the passages 1242*a* (FIG. 3).

Furthermore, the cover body 1242 has a plurality of through slots 1242*b*. The stopper 1244 includes a main body 12442 and a plurality of hooking portions 12444 extending from the main body 12442 and slidably passing through the through slots 1242*b* respectively. The hooking portion 12444 can hook the edge of the corresponding through slot 1242*b*, thereby preventing the stopper 1244 from being detached from the cover body 1242.

In addition, the cup-shaped container 12 is designed to be separable, allowing the cup body 122 and the cup cover 124 to be made of different materials, thereby facilitating structural design and manufacturing. For example, the cup body 122 is mainly made of stainless steel, facilitating forming a heat-insulating structure; the cup cover 124 is mainly made of plastic, facilitating making a fine structure.

Figure 9:
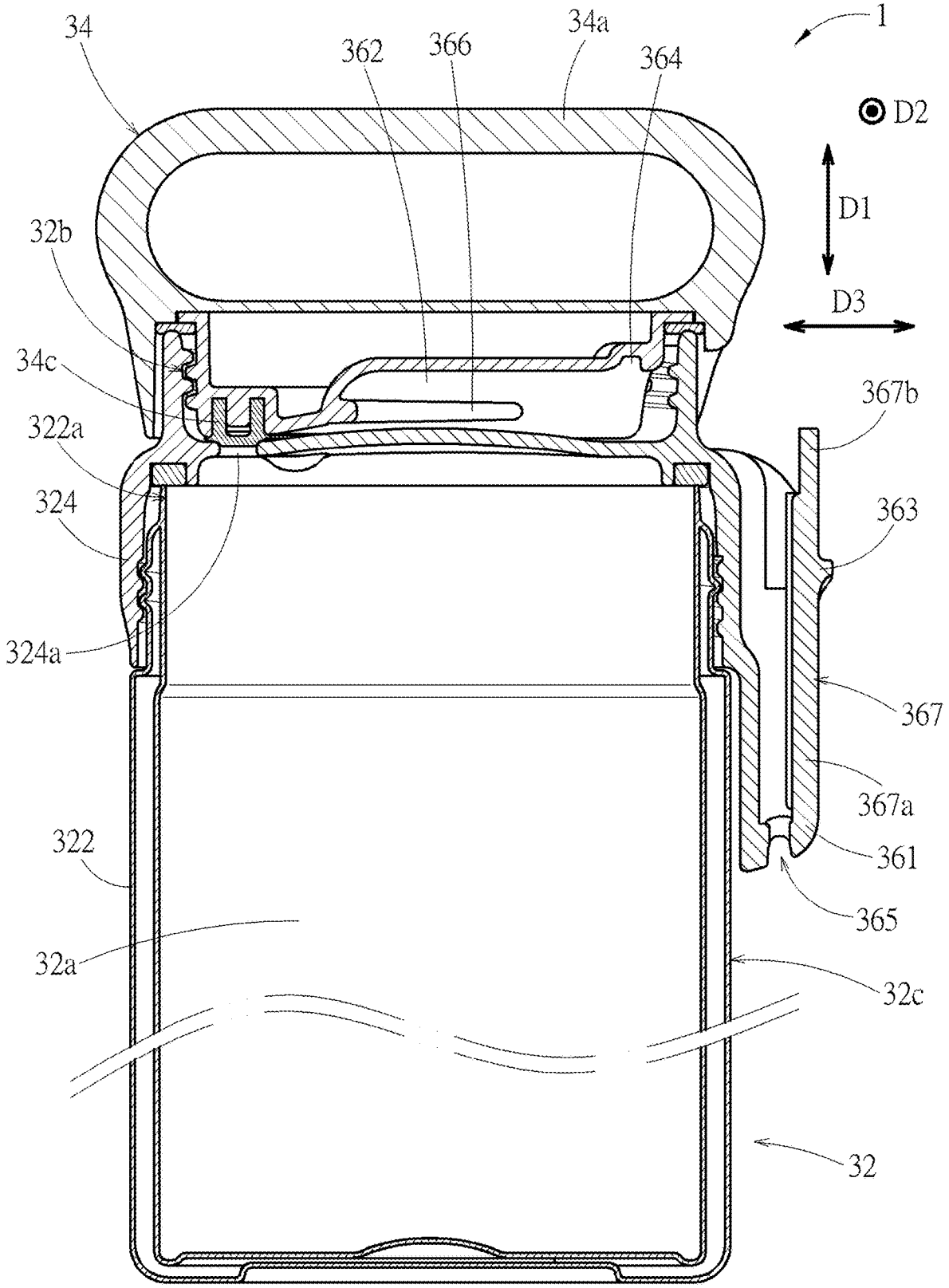
FIG. 9 is a sectional view of the liquid container assembly in FIG. 7 along the line Y-Y, with the top cover engaged with the container opening of the cup-shaped container.
Figure 10:
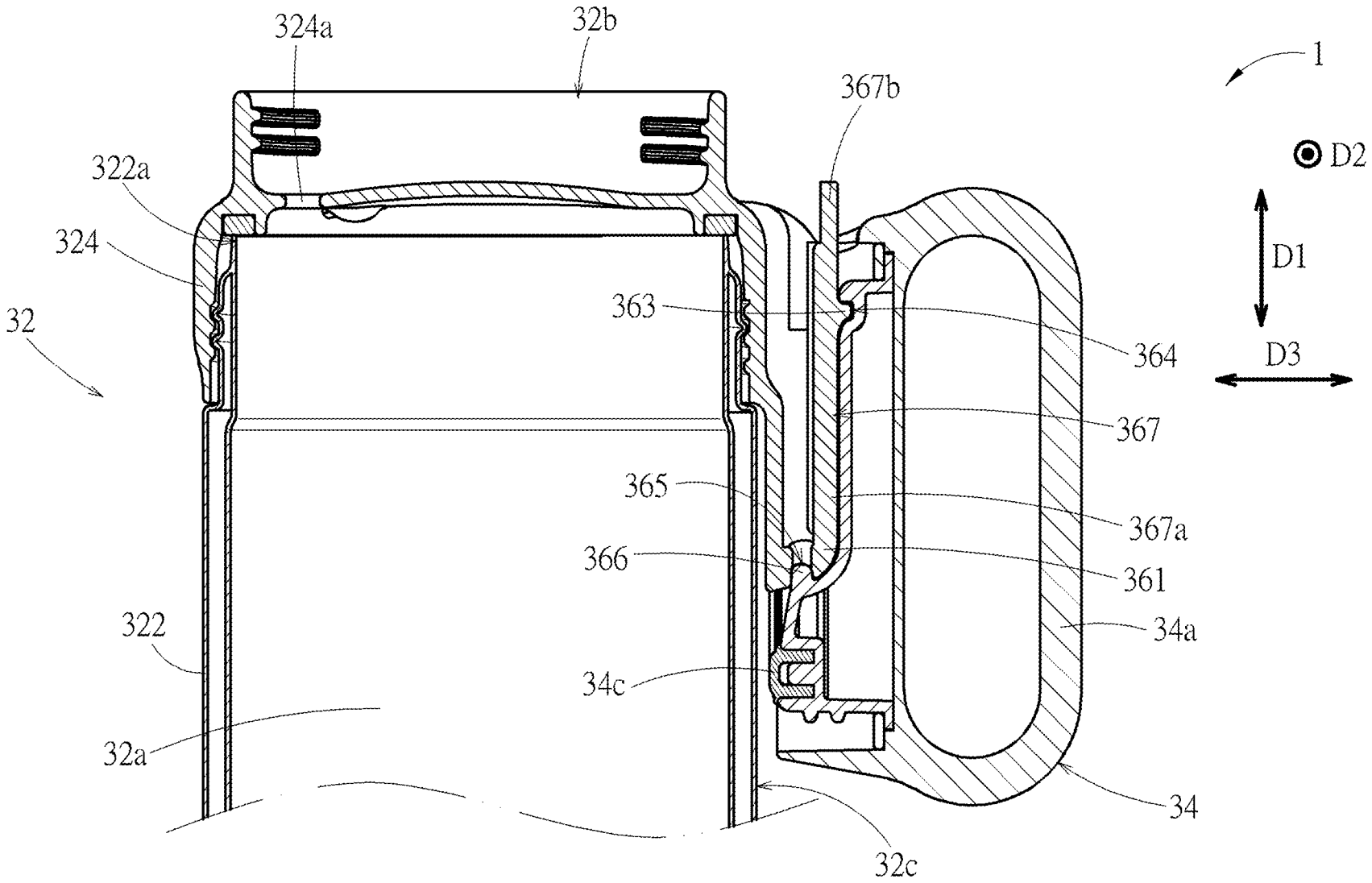
FIG. 10 is a sectional view of the liquid container assembly in FIG. 7 along the line Y-Y, with the top cover attached to a side of the cup-shaped container.

Please refer to FIG. 7 to FIG. 10. A liquid container assembly 3 according to another embodiment is similar to the liquid container assembly 1. For other descriptions of the components of this embodiment, please refer to the related descriptions of the components with the same name of the liquid container assembly 1 above, which will not be repeated in addition. The liquid container assembly 3 includes a cup-shaped container 32 and a top cover 34. The cup-shaped container 32 has a liquid accommodating space 32*a* (FIG. 9 and FIG. 10) and a container opening 32*b* communicating with the liquid accommodating space 32*a*. The top cover 34 can be selectively detachably engaged with the container opening 32*b* (e.g., by threaded connection) to cover the container opening 32*b* (indicated by the top cover 14 in FIG. 7 that is shown in dashed lines and covers the container opening 12*b*; its sectional view is shown by FIG. 9), or detachably engaged with the cup-shaped container 32 through an engagement structure so as to be firmly attached to a side of the cup-shaped container 32 and expose the container opening 32*b* (indicated by the top cover 34 in dashed lines in FIG. 7 attached to the side of the cup-shaped container 32; its sectional view is shown by FIG. 10). Similarly, a user can selectively attach the top cover 34 firmly to the side of the cup-shaped container 32, and then take out the contents (such as water, beverages, etc.) of the liquid accommodating space 32*a* through the container opening 32*b*; there is no need to worry about the top cover 34 shaking or rotating relative to the cup-shaped container 32 to affect the taking out.

In this embodiment, the engagement structure includes a protrusion block 361, a recess 362 structurally fitting the protrusion block 361, a hook 363, a lock slot 364 structurally fitting the hook 363, a narrow slot 365, and a plate rib 366 structurally fitting the narrow slot 365. The protrusion block 361 and the hook 363 are disposed on the cup-shaped container 32. The recess 362 and the lock slot 364 are disposed on the top cover 34. The narrow slot 365 is disposed on the protrusion block 361. The plate rib 366 is disposed in the recess 362. The top cover 34 moves upward from bottom to top (i.e., in the direction D1), and by the protrusion block 361 being inserted into the recess 362, the plate rib 366 being inserted into the narrow slot 365, and the hook 363 being snapped into the lock slot 364, the top cover 34 is firmly attached to the side of the cup-shaped container 32 and exposes the container opening 32*b* (FIG. 10). Afterward, the top cover 34 can be separated from the cup-shaped container 32 by disengaging the hook 363 from the lock slot 364 and moving the top cover 34 in the reverse direction.

Furthermore, the engagement structure includes a cantilever structure 367 that has a fixed end 367*a* fixed to the cup-shaped container 32, and a free end 367*b*. The cantilever structure 367 can provide a certain degree of elastic deflection range approximately in direction D3. The hook 363 is disposed on the cantilever structure 367 between the fixed end 367*a* and the free end 367*b*. Pressing the press button 367 can disengage the hook 363 from the lock slot 364. When the top cover 34 is on the side of the cup-shaped container 32, the free end 367*b* is exposed so that the user can press the free end 367*b* to release top cover 34 from the cup-shaped container 32 and then the top cover 34 can be moved away from the cup-shaped container 32.

Furthermore, the top cover 34 has a handle 34*a* and an inner surface 34*b*. The engagement structure is disposed on the inner surface 34*b*. When the top cover 34 is on the container opening 32*b*, the inner surface 34*b* of the top cover 34 faces an inner side of the cup-shaped container 32. When the top cover 34 is on the side of the cup-shaped container 32, the inner surface 34*b* of the top cover 34 faces an outer surface 32*c* of the cup-shaped container 32 and conforms to the outer surface 32*c*.

Furthermore, the cup-shaped container 32 includes a cup body 322, and a cup cover 324 detachably engaged with the opening 322*a* of the cup body 322 (e.g., by threaded connection) to form the liquid accommodating space 32*a*. The opening of the cup cover 324 serves as the container opening 32*b*. The cup cover 324 has a plurality of passages 324*a*, through which the liquid accommodating space 32*a* communicates with the outside. The top cover 34 has a blocking gasket 34*c* on the inner surface 34*b*. When the top cover 34 is on the container opening 32*b* to cover the container opening 32*b*, the blocking gasket 34*c* is against the cup cover 324 to close the passages 324*a* (FIG. 9). When the top cover 34 is removed away from the container opening 32*b*, the passages 324*a* are no longer blocked by the blocking gasket 34*c*, so that the liquid accommodating space 32*a* is open to the outside through the passages 324*a* (FIG. 10). In addition, the engagement structure is disposed on the cup cover 324. The protrusion block 361, the hook 363, the narrow slot 365, and the cantilever structure 367 are integrally formed with the main body of the cup cover 324, e.g., by plastic injection molding; this helps to reduce manufacturing costs. In addition, the cup-shaped container 32 is designed to be separable, allowing the cup body 322 and the cup cover 324 to be made of different materials, thereby facilitating structural design and manufacturing.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid container assembly, comprising:

a cup-shaped container, the cup-shaped container having a liquid accommodating space and a container opening communicating with the liquid accommodating space;

a top cover, the top cover being selectively detachably engaged with the container opening to cover the container opening, or detachably engaged with the cup-shaped container through an engagement structure so as to be firmly attached to a side of the cup-shaped container and expose the container opening, wherein the engagement structure comprises a protrusion block, a recess structurally fitting the protrusion block, a hook, and a lock slot structurally fitting the hook, the protrusion block and the recess are disposed on the cup-shaped container and the top cover oppositely, the hook and the lock slot are disposed on the cup-shaped container and the top cover oppositely, wherein the top cover is firmly attached to the side of the cup-shaped container and exposes the container opening, by the protrusion block being inserted into the recess, and the hook being snapped into the lock slot, wherein the engagement structure further comprises a narrow slot and a plate rib structurally fitting the narrow slot, the narrow slot and the plate rib are disposed on the cup-shaped container and the top cover oppositely, and when the top cover is firmly attached to the side of the cup-shaped container, the plate rib is inserted into the narrow slot, wherein the narrow slot is formed on the protrusion block and extends along a U-shaped path on three sides of the protrusion block, and the plate rib is correspondingly disposed in the recess and extends along a U-shaped path.

2. A liquid container assembly, comprising:

a cup-shaped container, the cup-shaped container having a liquid accommodating space and a container opening communicating with the liquid accommodating space, wherein the cup-shaped container comprises a cup body and a cup cover, the cup cover being detachably engaged with an opening of the cup body to form the liquid accommodating space;

a top cover, the top cover being selectively detachably engaged with the container opening to cover the container opening, or detachably engaged with the cup-shaped container through an engagement structure so as to be firmly attached to a side of the cup-shaped container and expose the container opening, wherein the engagement structure is disposed on the cup cover.

3. The liquid container assembly according to claim 2, wherein the cup-shaped container has a passage connecting the liquid accommodating space and the container opening, the top cover has a blocking gasket, and when the top cover is detachably engaged with the container opening to cover the container opening, the blocking gasket closes the passage.

* * * * *